US007817169B2

(12) United States Patent
Endo et al.

(10) Patent No.: US 7,817,169 B2
(45) Date of Patent: Oct. 19, 2010

(54) DISPLAY DEVICE

(75) Inventors: Kenta Endo, Mobara (JP); Yoshihisa Ooishi, Yokohama (JP)

(73) Assignee: Hitachi Displays, Ltd., Chiba (JP)

( * ) Notice: Subject to any disclaimer, the term of this patent is extended or adjusted under 35 U.S.C. 154(b) by 1002 days.

(21) Appl. No.: 11/602,244

(22) Filed: Nov. 21, 2006

(65) Prior Publication Data

US 2007/0115233 A1 May 24, 2007

(30) Foreign Application Priority Data

Nov. 21, 2005 (JP) ..... 2005-335074

(51) Int. Cl.
*G09G 5/10* (2006.01)
*G09G 3/36* (2006.01)

(52) U.S. Cl. ..... 345/690; 345/87; 345/89; 345/90; 345/204

(58) Field of Classification Search ..... 345/55, 345/76, 77, 87, 89, 90, 92, 204, 205, 206, 345/690

See application file for complete search history.

(56) References Cited

U.S. PATENT DOCUMENTS 5,796,379 A * 8/1998 Enomoto et al. ..... 345/89
6,831,620 B1 * 12/2004 Nishikubo et al. ..... 345/87
6,836,293 B2 * 12/2004 Itoh et al. ..... 348/452
6,876,367 B2 * 4/2005 Wada et al. ..... 345/690
7,602,365 B2 * 10/2009 Endo et al. ..... 345/98
7,659,875 B2 * 2/2010 Miyazaki ..... 345/89
2004/0101058 A1 5/2004 Sasai et al.
2004/0246242 A1 * 12/2004 Sasaki ..... 345/204
2005/0162360 A1 7/2005 Ishihara et al.
2007/0195073 A1 * 8/2007 Izumi ..... 345/204

FOREIGN PATENT DOCUMENTS

| | | |
|---|---|---|
| CN | 1684134 | 10/2005 |
| JP | 2003-280599 | 10/2003 |
| JP | 2005-006275 | 1/2005 |
| KR | 2002-0017318 | 3/2002 |

* cited by examiner

*Primary Examiner*—My-Chau T Tran
(74) *Attorney, Agent, or Firm*—Antonelli, Terry, Stout & Kraus, LLP.

(57) ABSTRACT

The present invention provides a display device which can reduce motion picture blurring while suppressing the lowering of luminance, the lowering of contrast or the increase of electric power necessary for emission of light. In a hold-type display device which holds a display of gradations for 1 frame period, each pixel displays 1 gradation required by an external system by displaying a plurality of gradations within 1 frame period, and the plurality of gradations within 1 frame period is displayed based on voltages which are generated by gradation voltage generation circuits which differ from each other.

3 Claims, 11 Drawing Sheets

FIG. 12

| m−1 | $R_{BPm'}$, $R_{BNm}$(Ω) | $R_{DPm'}$, $R_{DNm}$(Ω) |
|---|---|---|
| 0 | 10 | ≒0 |
| 1 | 9 | ≒0 |
| 2 | 10 | ≒0 |
| ⋮ | ⋮ | ⋮ |
| 62 | 9 | ≒0 |
| 63 | 10 | ≒0 |
| 64 | 10 | ≒0 |
| ⋮ | ⋮ | ⋮ |
| 126 | 35 | ≒0 |
| 127 | 40 | ≒0 |
| 128 | 45 | ≒0 |
| ⋮ | ⋮ | ⋮ |
| 190 | 100 | ≒0 |
| 191 | ≒0 | 10 |
| 192 | ≒0 | 11 |
| ⋮ | ⋮ | ⋮ |
| 253 | ≒0 | 20 |
| 254 | ≒0 | 18 |
| 255 | ≒0 | 20 |

DISPLAY DEVICE

The present application claims priority from Japanese application JP2005-335074 filed on Nov. 21, 2005, the content of which is hereby incorporated by reference into this application.

BACKGROUND OF THE INVENTION

1. Field of the Invention

The present invention relates to a hold-response type display device such as a liquid crystal display, an organic EL (Electro Luminescence) display, an LCOS (Liquid Crystal On Silicon) display, and more particularly to a display device which is applicable to a display of motion pictures.

2. Description of the Related Art

Conventionally, in classifying a display from a viewpoint of a motion picture display, the display is roughly classified into an impulse-response-type display and a hold-response-type display. The impulse-response-type display is, for example, a display of a type in which the luminance response is lowered directly after scanning as in the case of a residual light characteristic of a cathode ray tube. Further, the hold-response-type display is, for example, a display of a type in which the luminance based on display data is held until next scanning as in the case of a liquid crystal display.

The hold-response type display can obtain a favorable display quality without generating flickers when a still picture is displayed. However, when the hold-response type display displays motion pictures, there exists a drawback that, so-called motion picture blurring in which a periphery of a moving object is blurred occurs so that the display quality is remarkably lowered. The generation of the motion picture blurring is caused by a so-called image retention on retina in which, when a line of sight moves along with the movement of the object, an observer interpolates display images before and after the movement with respect to a display image with which the luminance is fixed. Therefore, in the hold-response type display, even when an attempt to increase a response speed to maximum is made, it is impossible to completely eliminate the motion picture blurring. Accordingly, there has been proposed a method in which, in the hold-response type display, for example, by updating the display image with a shorter frequency, or by canceling the image retention on retina by inserting a black screen or the like, the hold-response type display is allowed to approach the impulse-response type display whereby the motion picture blurring is reduced.

A typical display which requires the motion picture display is a television receiver set, and a scanning frequency of the television receiver set is standardized in such a manner that the scanning frequency of NTSC type television receiver set is interlaced scanning of 60 Hz and the scanning frequency of PAL type television receiver set is sequential scanning of 50 Hz. When a frame frequency of a display image which is generated based on the scanning frequency is set to 60 Hz or 50 Hz, the frequency is not increased and hence, the motion picture blurring is generated.

To reduce the motion picture blurring in the television receiver set, as a technique which updates display image with the shorter frequency as mentioned above, there has been proposed a technique in which a scanning frequency is increased and, at the same time, display data of an interpolation frame is generated based on display data between frames thus enhancing an updating speed of the image (hereinafter, abbreviated as an interpolation frame generation method) (for example, see patent document 1).

Further, as a technique which inserts the black screen (the black frame) as mentioned above, for example, there has been proposed a method which inserts black display data between display data (hereinafter, abbreviated as a black display data inserting method) (for example, see patent document 2).

Patent document 1: JP-A-2005-6275 (related US2004/101058)

Patent document 2: JP-A-2003-280599 (related US2004/0001054)

SUMMARY OF THE INVENTION

Although, it may be possible to reduce the motion picture blurring by providing the above-mentioned techniques to the hold-response type display, the provision of the above-mentioned technique brings about following drawbacks.

In the interpolation frame generation method, the display data of the interpolation frame which is not originally present is formed. Accordingly, in an attempt to form the more accurate display data, a circuit scale is increased. On the other hand, when the circuit scale is decreased, errors occur in the formation of display data of the interpolation frame and hence, there exists a possibility that the display quality is remarkably lowered.

On the other hand, in the method which inserts the black frame, in principle, no errors occur in the formation of the display data of the interpolation frame. Further, also with respect to the circuit scale, the method is advantageous compared to the interpolation frame generation method. However, in either one of the black display data insertion method and the blink backlight method, the display luminance in the total gradation is reduced by an amount corresponding to the black frame. Although an attempt to increase the luminance of a backlight in the black display data insertion method is made, for example, to compensate for the lowering of luminance, the power consumption is increased corresponding to the elevation of the luminance and, at the same time, it requires considerable efforts to cope with the generation of heat. Further, due to the increase of an absolute value of leaking of light in the black display, a contrast is lowered. Still further, in the above-mentioned blink backlight method, a large current is required for shifting a lighting state from a turn-off state to a turn-on state, and coloring attributed to a fact that a response speed of a visible light differs for every wavelength due to the difference in phosphor materials occurs.

Accordingly, it is an object of the present invention to provide a display device which can reduce motion picture blurring while suppressing the lowering of luminance, the lowering of contrast and the increase of power consumption necessary for emission of light.

The above-mentioned and other objects of the present invention and novel features of the present invention will become apparent from the description of this specification and attached drawings.

To explain the summary of the invention disclosed in this specification, it is as follows.

(1) The present invention is directed to a display device which holds a display of gradations for 1 frame period, wherein each pixel displays 1 gradation which is required by an external system by displaying a plurality of gradations within 1 frame period, and the plurality of gradations within 1 frame period is displayed based on voltages generated by gradation voltage generation circuits which are different from each other.

(2) In the display device having the above-mentioned constitution (1), when the gradation which is required by the external system is an intermediate gradation between a maximum gradation and a minimum gradation, at least 1 gradation out of the plurality of gradations within the 1 frame period is lower than the gradation which is required by the external system.

(3) In the display device having the above-mentioned constitution (2), when the gradation which is required by the external system is the intermediate gradation, at least 1 gradation out of the plurality of gradations within the 1 frame period is the minimum gradation.

(4) In the display device having the above-mentioned constitution (3), when the gradation which is required by the external system is contained in a low gradation side out of the intermediate gradation, at least 1 gradation out of the plurality of gradations within the 1 frame period is the minimum gradation, and when the gradation which is required by the external system is contained in a high gradation side out of the intermediate gradation, at least another 1 gradation out of the plurality of gradations within the 1 frame period is the maximum gradation.

(5) In a display device which displays gradations corresponding to display data inputted from an external system, the display device comprising:

a display panel having a plurality of pixels which is arranged in a matrix array;

a memory which is capable of holding the display data inputted from the external system amounting to 1 frame period;

first and second gradation conversion circuits which convert an intermediate gradation of the display data to a gradation different from the intermediate gradation;

a signal generation circuit which generates a control signal for driving the display panel based on an input signal from the external system;

a first driver which outputs voltages corresponding to the gradations of the display data to the pixels of the display panel; and a second driver which scans the pixels to which the voltages are to be supplied, the first driver includes a first voltage generation circuit which generates voltages to be outputted to the respective pixels of the display panel based on the display data converted by the first gradation conversion circuit, and a second voltage generation circuit which generates voltages to be outputted to the respective pixels of the display panel based on the display data converted by the second gradation conversion circuit, the first gradation conversion circuit converts gradations of the first display data read out from the memory firstly, the second gradation conversion circuit converts gradations of the second display data read out from the memory secondly, when the display data inputted from the external system is an intermediate gradation, luminance attributed to the second display data after conversion is lower than luminance attributed to the first display data after conversion, the second driver scans the pixels twice within 1 frame period in response to the control signal, and the first driver outputs the voltage which is generated by the first voltage generation circuit corresponding to the first display data after conversion to the pixels in response to the first scanning by the second driver, and outputs the voltage which is generated by the second voltage generation circuit corresponding to the second display data after conversion to the pixels in response to the second scanning by the second driver.

(6) In the display device having the above-mentioned constitution (5), the first and second voltage generation circuits respectively include a circuit which generates a voltage of a positive polarity and a circuit which generates a voltage of a negative polarity.

(7) In the display device having the above-mentioned constitution (6), the first voltage generation circuit generates a voltage corresponding to the maximum gradation when the gradation is higher than a predetermined gradation, and the second voltage generation circuit generates a voltage corresponding to the minimum gradation when the gradation is lower than the predetermined gradation.

(8) In the display device having the above-mentioned constitution (7), the first and second voltage generation circuits are respectively formed of a resistance voltage dividing circuit in which a plurality of resistances is connected in series, a resistance division ratio of the first voltage generation circuit is set such that the resistance division ratio on a high gradation side out of the intermediate gradation is substantially 0, and a resistance division ratio of the second voltage generation circuit is set such that the resistance division ratio on a low gradation side out of the intermediate gradation is substantially 0.

(9) In the display device having the above-mentioned constitution (8), a reference voltage is inputted to the first and second voltage generation circuits from a plurality of portions respectively, the first voltage generation circuit has many portions to which the reference voltage is inputted on the low gradation side, and the second voltage generation circuit has many portions to which the reference voltage is inputted on the high gradation side.

According to the present invention, different from the insertion of the black gradations without depending on the gradations requested by the external system, as described in the constitution (1) to the constitution (4), when the gradations requested by the external system are on the low gradation side, the display is performed by changing over the predetermined gradation with the minimum gradation (the black gradation) and hence, it is possible to perform the display of the gradations requested by the external system in a pseudo displaying manner. Then, when the gradations requested by the external system is on the high gradation side, the display is performed by changing over the predetermined gradation with the maximum gradation and hence, it is possible to perform the display of the gradations requested by the external system in a pseudo displaying manner. Accordingly, it is possible to reduce the motion picture blurring while suppressing the lowering of luminance, the lowering of contrast and the increase of the electric power necessary for emission of light.

That is, when the luminance is low (low gradation side), the motion picture blurring is liable to be easily recognized and hence, the motion picture blurring is reduced by the insertion of the minimum gradation, while when the luminance is high (high gradation side), the motion picture blurring is hardly recognized and hence, it is possible to reduce the lowering of the luminance or the lowering of contrast by increasing the low gradation to be inserted.

Further, when the gradations requested by the external system are displayed in a pseudo displaying manner as in the case of the constitution (1) to the constitution (4), the intermediate gradation is displayed by changing over the gradation between the gradation higher than the gradations requested by the external system and the gradation lower than the gradations requested by the external system. Here, the gradation higher than the required gradation becomes the maximum gradation on the high gradation side and the gradation lower than the required gradation becomes the minimum gradation on the low gradation side. Accordingly, by forming voltages of the plurality of gradations by the gradation voltage generation circuits which are different from each other as in the case of the constitution (1), it is possible to realize the gradation characteristics which are respectively optimum to the case in which the gradation higher than the required gradation is displayed and the case in which the gradation lower than the required gradation is displayed.

Further, specific constitutional examples of the display device having the constitution (1) to the constitution (4), for example, adopt the constitution (5) to the constitution (9) described above.

BRIEF DESCRIPTION OF THE DRAWINGS

FIG. 12 is a view showing an example in which resistance values of the respective resistance voltage dividing circuits are set.

DESCRIPTION OF THE PREFERRED EMBODIMENTS

Figure 1:
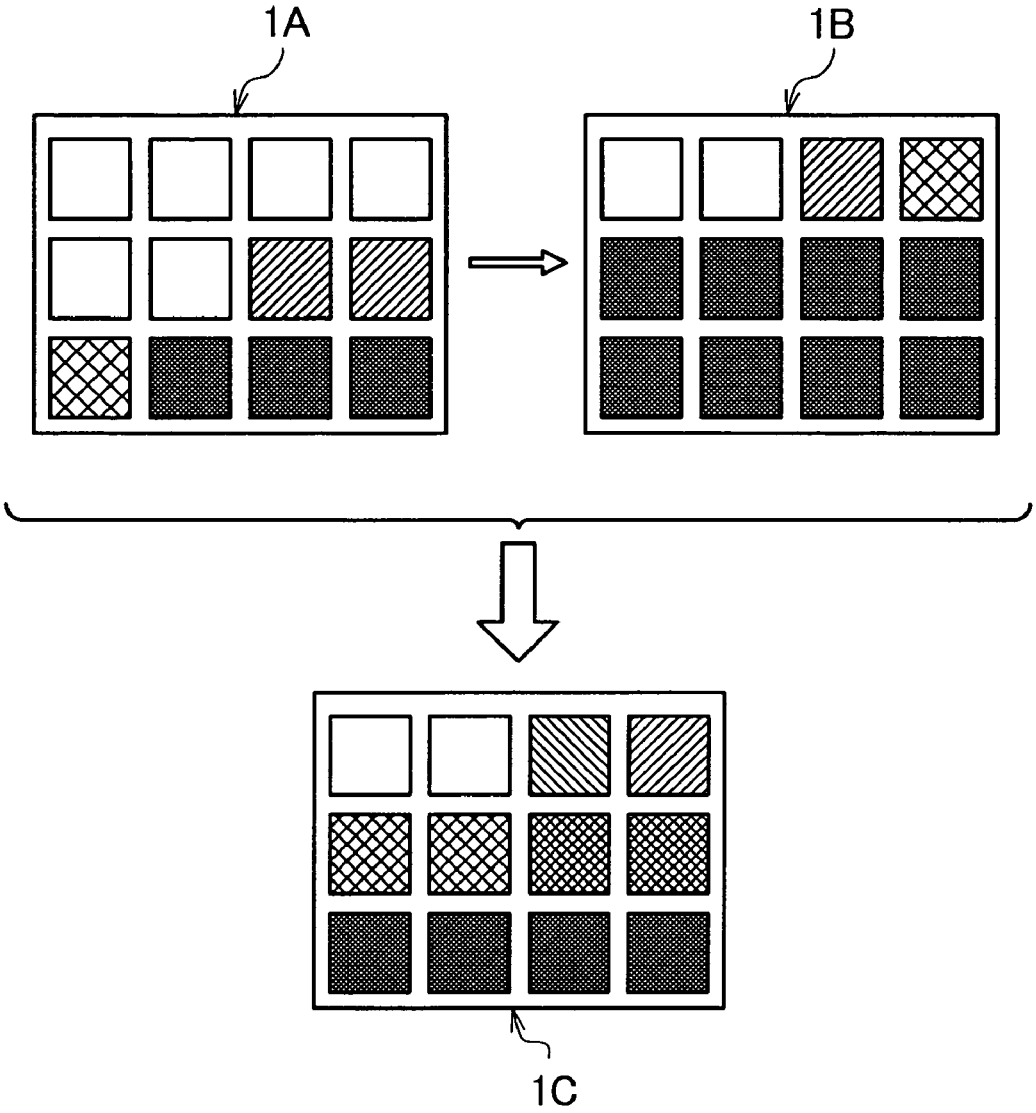
FIG. 1 is a schematic view for explaining a display principle of a display device of one embodiment according to the present invention, wherein an image of dynamic luminances and visual observation luminances of respective fields of the display device which is constituted of (4×3) pixels is shown.

Hereinafter, the present invention is explained in detail in conjunction with embodiments by reference to drawings.

Here, in all drawing for explaining the embodiments, parts having identical functions are indicated by same symbols and their repeated explanation is omitted.

Further, in the explanation made hereinafter, a period amounting to 1 screen inputted from an external system is defined as 1 frame period, and a period in which all scanning lines are selected with respect to a display panel is defined as 1 field period. Accordingly, in a general display device, 1 frame period and 1 field period become equal to each other.

Further, in the display device, luminance which is obtained due to the repeated scanning based on display data in a fixed state is defined as static luminance, average luminance within 1 field period is defined as dynamic luminance, and luminance which a viewer observes with naked eyes defines as visual observation luminance. Accordingly, in the general hold-response-type display device, unless the display data is changed, the static luminance, the dynamic luminance and the visual observation luminance become substantially equal to each other.

In the present invention, a plurality of field periods (for example, 2 field periods) is allocated to 1 frame period inputted from the external system and, at the same time, the conversion of display data is performed such that the visual observation luminance obtained from the dynamic luminances of the plurality of fields agrees with the display luminance which the external system requires. Here, the visual observation luminance substantially agrees with the average value of dynamic luminance in the plurality of field periods.

The above-mentioned conversion of display data is performed such that the dynamic luminance of one field becomes higher or higher than or equal to the dynamic luminance of another field in all gradations. In the explanation made hereinafter, when such a conversion is performed, the field having the higher luminance compared to another field is referred to as a bright field and the field which exhibits the lower luminance is refereed to as a dark field.

When 2 fields are allocated to 1 frame period inputted from the external system, the hold response type display device of the present invention includes a frame memory which stores display data amounting to at least 1 screen and two kinds of data conversion circuits. The display data which is written in the frame memory reads out the same data two times at a speed twice as fast as a writing speed and, at the same time, the conversion of display data is performed by data conversion circuits which are different from each other between first time and second time, and the data after conversion is transferred to the display panel as the input data to the display panel.

Here, assuming the static luminance takes a value which holds within a range from 0 to 1, for example, when the dynamic luminance of the bright field is set to 0.5 and the dynamic luminance of the dark field is set to 0, by changing over these values for every field, it is possible to obtain the visual observation luminance of 0.25. In the same manner, by setting the dynamic luminance of the bright field to 1 and the dynamic luminance of the dark field to 0, it is possible to obtain the visual observation luminance of 0.5. In this manner, when the dynamic luminance of the dark field is 0, it is possible to obtain advantageous effects similar to advantageous effects of the black frame insertion method thus reducing the motion picture blurring.

Here, it is not always necessary to set the dynamic luminance of the bright field to 0 which is the minimum luminance and the motion picture blurring can be reduced by inserting the field which assumes the visual observation luminance to be displayed. Based on such understanding, when the dynamic luminance of the bright field is set to 1 and the dynamic luminance of the dark field is set to 0.5, the visual observation luminance becomes 0.75. Even in such a case, it is possible to reduce the motion picture blurring than a usual driving method. Further, when the dynamic luminances of both of the bright field and the dark field are set to 1, the visual observation luminance also becomes 1 and hence, the luminance is not lowered. Further, by setting the dynamic luminance of the bright field to 1 and the dynamic luminance of the dark field to 0.9, the visual observation luminance becomes 0.95. Although the luminance is slightly lowered compared to the usual driving method, it is possible to reduce the motion picture blurring corresponding to the visual observation luminance.

Further, as a technique which is similar to the present invention, a multiple gradation method which is referred to as so-called FRC (Frame Rate Control) method is generally known. The FRC method is a method which realizes the multiple gradation which exceeds the gradation that a data driver includes by repeating different gradation displays for every frame. To the contrary, the present invention provides the reduction of the motion picture blurring and the device which realizes the reduction of the motion picture blurring. To realize the reduction of the motion picture blurring and the device which realizes the reduction of the blurring, 1 frame period is divided in the dark field and the bright field and, at the same time, the driving is performed at a frequency which is twice as large as the frame frequency inputted from the external system.

Hereinafter, the embodiment of the present invention in which 1 frame is driven with 2 fields is explained.

Embodiment

Figure 2:
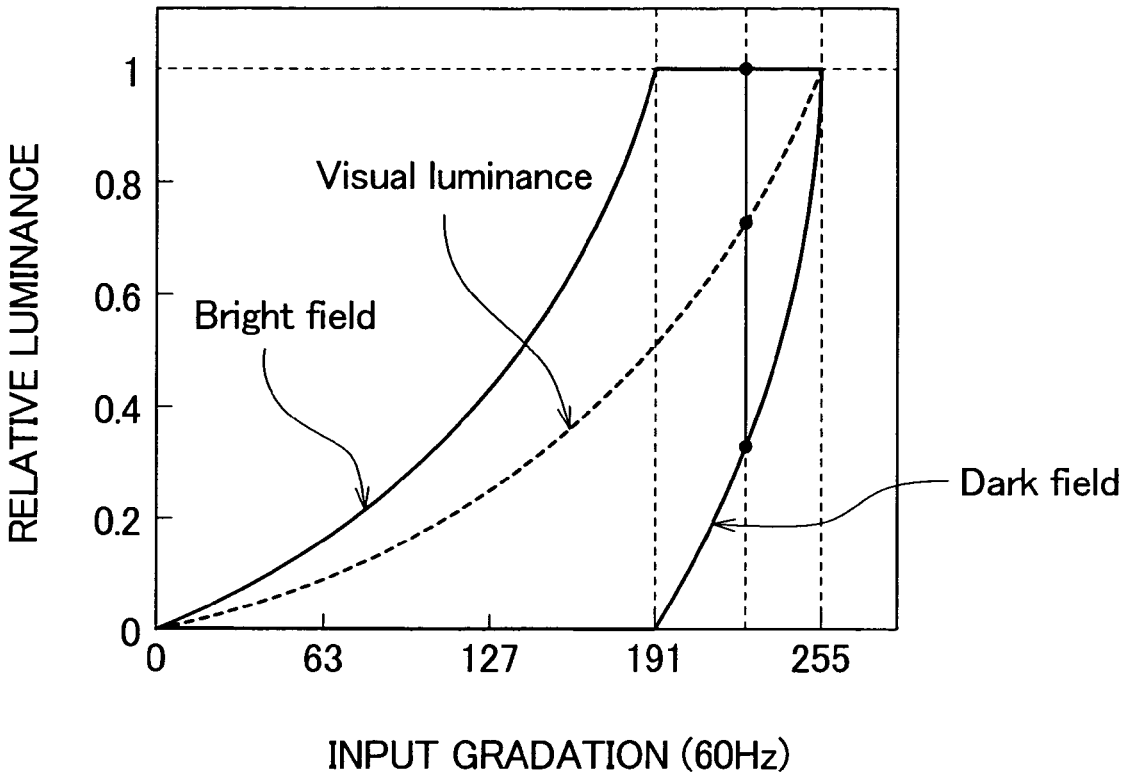
FIG. 2 is a schematic view for explaining the display principle of the display device of one embodiment according to the present invention, and also is a graph for explaining a method of setting dynamic luminances of respective fields.

FIG. 1 and FIG. 2 are schematic views for explaining a display principle of a display device of one embodiment according to the present invention, wherein FIG. 1 is an image of dynamic luminances and visual observation luminances of respective fields of the display device which is constituted of (4×3) pixels, and FIG. 2 is a graph for explaining a method of setting dynamic luminances of respective fields.

To explain the display principle of the display device of this embodiment, as shown in FIG. 1, the display device having (4×3) pixels is provided. In the display device of this embodiment, 1 frame is constituted of 2 fields, that is, a bright field and a dark field, wherein the display device performs a bright-field display and a dark-field display within 1 frame period. Here, the display is performed such that the dynamic luminance 1A of each pixel in one field (the bright field) is always higher than or equal to the dynamic luminance 1B of each pixel in another field (dark field). That is, in all pixels, the relationship (dynamic luminance of bright field)≧(dynamic luminance of dark field). By adopting such a constitution, the visual observation luminance 1C of each pixel during 1 frame period substantially agrees with an average of the dynamic luminance 1A of the bright field and the dynamic luminance 1B of the dark field. Accordingly, by repeating such a display for every frame, it is possible to obtain the target visual observation luminance.

Further, in such an operation, the dynamic luminance 1A of the bright field and the dynamic luminance 1B of the dark field are, for example, set by a method shown in FIG. 2. FIG. 2 is a graph showing the relationship of relative luminance with respect to input gradation, and shows a case in which the luminance of each pixel has 256 gradations. Further, in FIG. 2, a dotted line indicates the visual observation luminance which is required by the external system, wherein when the input gradation is 0, the luminance becomes 0 (minimum luminance) and when the input gradation is 255, the luminance becomes 1 (maximum luminance).

In this embodiment, the visual observation luminance of each pixel is obtained by synthesizing the dynamic luminance of the bright field and the dynamic luminance of the dark field. Accordingly, when the input gradation is intermediate gradation, the relative luminance (dynamic luminance) of the bright field is set higher than the visual observation luminance required by the external system, while the relative luminance (dynamic luminance) of the bark field is set lower than the visual observation luminance required by the external system.

Here, the luminance of the bright field assumes the maximum luminance at 191 gradation where the relative luminance of the visual observation luminance becomes 0.5, and the bright field is displayed with the maximum luminance from 191 gradation to 255 gradation. On the other hand, the luminance of the dark field assumes the minimum luminance up to 191 gradation where the relative luminance of the visual observation luminance becomes 0.5, and the luminance is continuously changed from the minimum luminance to maximum luminance between 191 gradation and 255 gradation.

Figure 3:
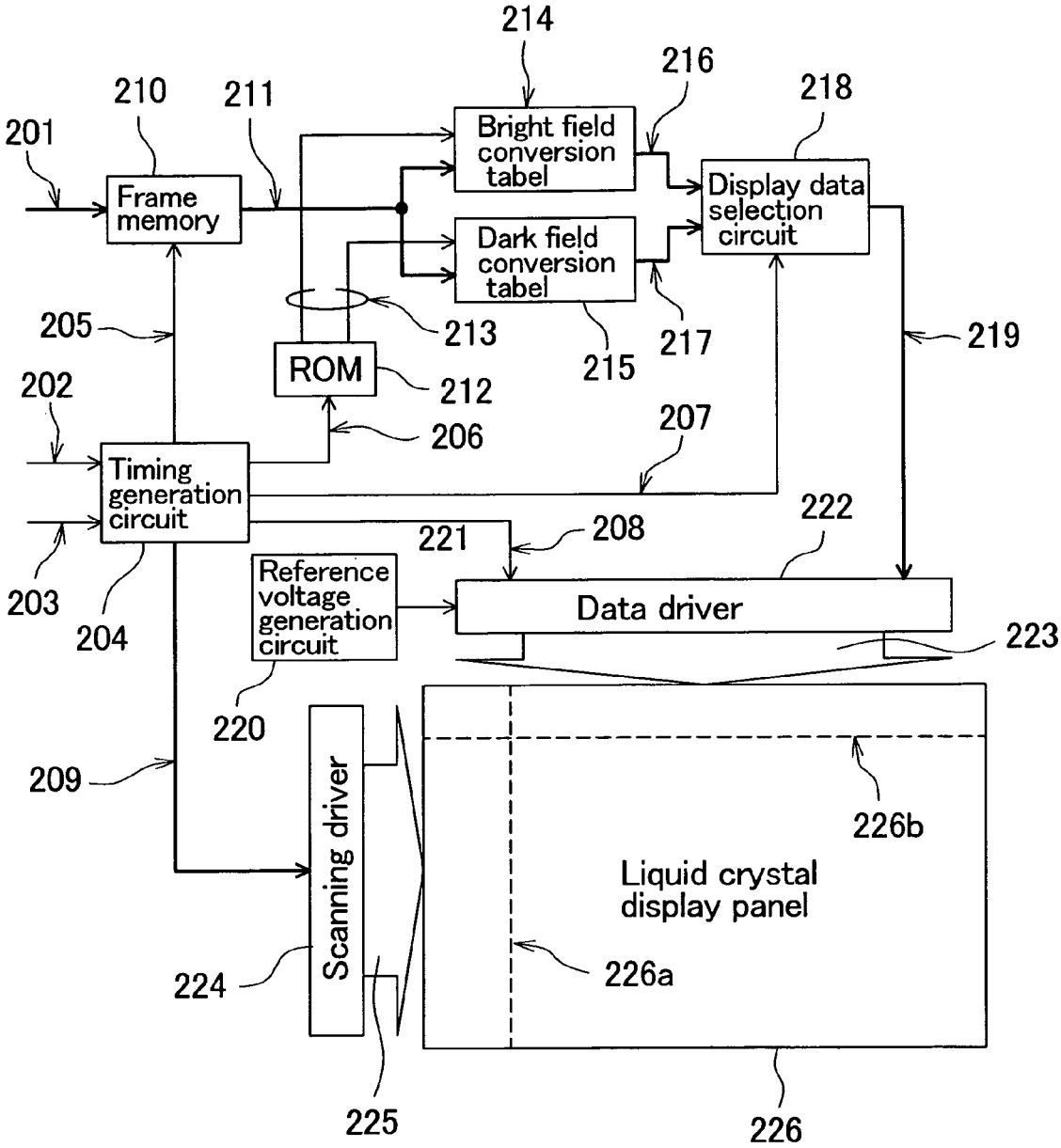
FIG. 3 is a schematic view showing one example of the circuit constitution of a liquid crystal display device to which the display principle of the embodiment is applied.
Figure 4:
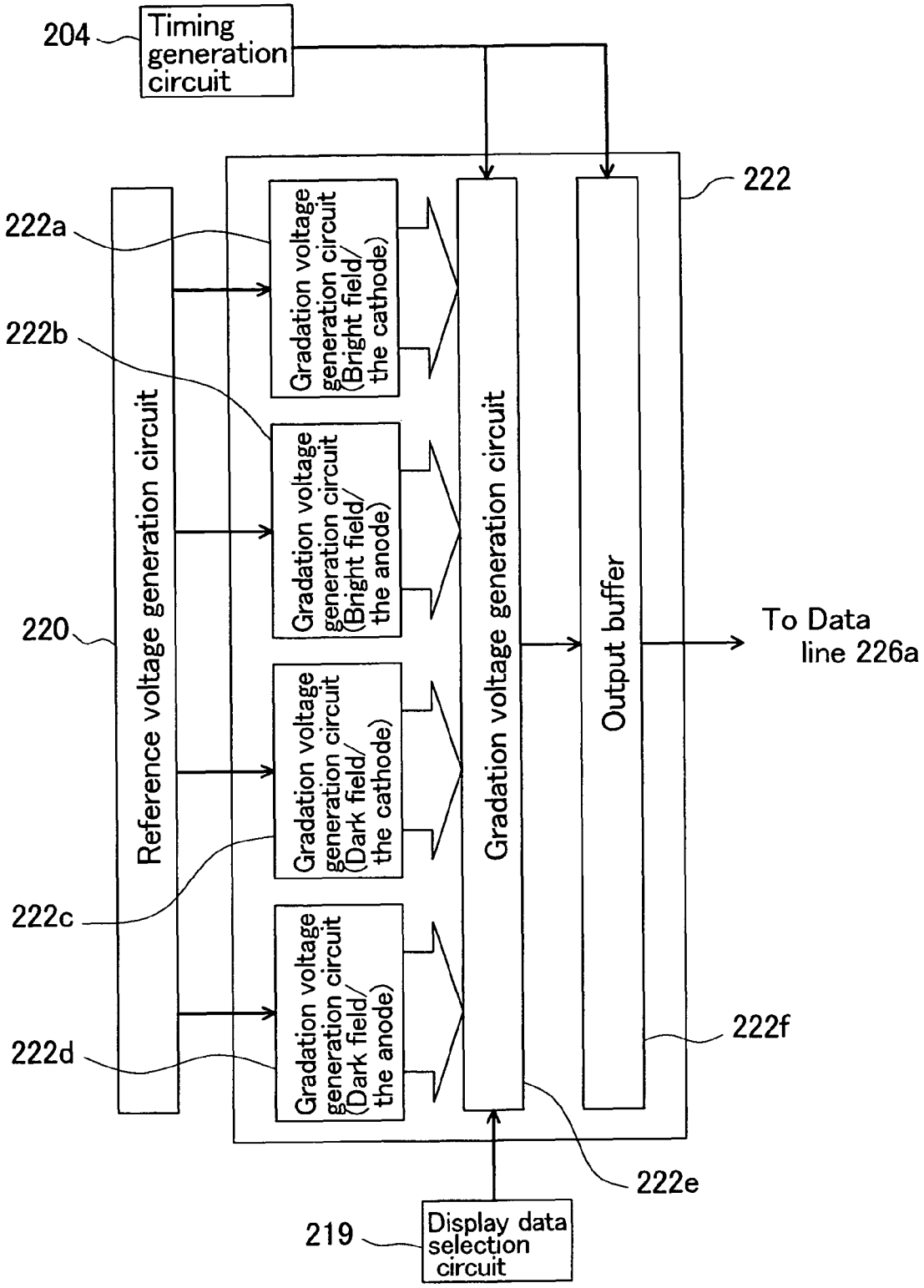
FIG. 4 is a schematic view showing one example of the circuit constitution of a data driver shown in FIG. 3.

FIG. 3 is a schematic view showing one example of the circuit constitution of a liquid crystal display device to which the display principle of the embodiment is applied, and FIG. 4 is a schematic view showing one example of the circuit constitution of a data driver shown in FIG. 3.

The liquid crystal display device of this embodiment is formed of a display device which is capable of performing a color display of 16,770,000 colors in which respective colors R, G, B have 256 gradations. In FIG. 3, numeral 201 indicates input display data of 24 bits in total consisting of 8 bits for each color of R, G, B, and numeral 202 indicates a group of input control signals. The group of the input control signals 202 is constituted of a vertical synchronizing signal Vsync which defines 1 frame period (period displaying 1 screen), a horizontal synchronizing signal Hsync which defines 1 horizontal scanning period (period displaying 1 line), a display timing signal DISP which defines an effective period of display data, and a reference clock signal DCLK which is synchronized with the display data. Further, in FIG. 3, numeral 203 indicates a drive selection signal. In response to this drive selection signal 203, either a conventional drive method or a drive method which reduces the motion picture blurring is selected. Further, the input display data 201, the group of input control signals 202 and the drive selection signal 203 are, for example, transferred from the external system such as a television receiver set body, a PC body, a mobile phone body or the like.

Further, in FIG. 3, numeral 204 indicates a timing signal generation circuit, numeral 205 indicates a group of memory control signals, numeral 206 indicates a table initializing signal, numeral 207 indicates a data selection signal, numeral 208 indicates a group of data driver control signals, and numeral 209 indicates a group of scanning driver control signals. The group of data driver control signals 208 is constituted of an output timing signal CL1 which defines output timing of gradation voltages based on display data, an AC signal M which determines the polarity of a source voltage, and a clock signal PCKL which is synchronized with the display data. Further, the group of scanning driver control signals 209 is constituted of a shift signal CL3 which defines a scanning period of 1 line and a vertical start signal FLM which defines scanning starting of a head line.

Further, in FIG. 3, numeral 210 is a frame memory which has capacity amounting to at least 1 frame of the display data, wherein the frame memory 210 performs read/write processing of display data based on the group of memory control signals 205. Further, numeral 211 indicates memory read data which is read out from the frame memory 210 based on the group of the memory control signals 205, numeral 212 indicates a ROM (Read Only Memory) which outputs data stored in the inside thereof based on the table initializing signal, numeral 213 indicates table data outputted from the ROM 212, numeral 214 indicates a bright field conversion table, and numeral 215 indicates a dark field conversion table. Here, values of respective tables are determined based on the table data 213 at the time of supplying electricity and the read memory read data 211 is converted based on values which are set at the respective tables. Here, the bright field conversion table 214 has a function of a data conversion circuit for the bright field, while the dark field conversion table 215 has a function of a data conversion circuit for the dark field. In FIG. 3, numeral 216 indicates bright field display data converted by the bright field conversion table 214, and numeral 217 indicates dark field display data converted by the dark field conversion table 215. Further, numeral 218 indicates a display data selection circuit, wherein the display data selection circuit 218 selects and outputs either one of the bright field display data 216 and the dark field display data 217 based on the data selection signal 207. Numeral 219 indicates field display data, wherein the field display data 219 is constituted of the selected display data and a field indication signal F indicative of whether the display data is the bright field data or the dark field data.

Further, in FIG. 3, numeral 220 indicates a reference voltage generation circuit, numeral 221 indicates a reference voltage, and numeral 222 indicates a data driver. Here, the data driver 222 includes, for example, as shown in FIG. 4, four gradation voltage generation circuits described later, a gradation voltage selection circuit 222*e* which selects a gradation voltage of 1 level corresponding to field display data 219 of respective colors of 8 bits, the field indication signal F and the polarity signal M, and an output buffer 222*f* which outputs the selected gradation voltage selected based on the output timing signal CL1 to a signal line 226*a* of the liquid crystal display panel 226. Here, four gradation voltage generation circuits are constituted of a first gradation voltage generation circuit 222*a* which generates a potential of a positive polarity 256 level with respect to the bright field display data, a second gradation voltage generation circuit 222*b* which generates a potential of negative polarity 256 level with respect to the bright field display data, a third gradation voltage generation circuit 222*c* which generates a potential of positive polarity 256 level with respect to the dark field display data, and a fourth gradation voltage generation circuit 222*d* which generates a potential of negative polarity 256 level with respect to the dark field display data. In the above-mentioned constitution, when the data driver 222 includes the above-mentioned first to fourth gradation voltage generation circuits 222*a* to 222*d*, these gradation voltage generation circuits 222*a* to 222*d* may be used in place of the bright field conversion table 214 and the dark field conversion table 215 shown in FIG. 3. Further, it is not always necessary to provide the first to fourth gradation voltage generation circuits 222*a* to 222*d* in the inside of the data driver 222 and these gradation voltage generation circuits 222*a* to 222*d* may be provided outside the data driver 222. In FIG. 3, numeral 223 indicates data voltages (gradation voltages) which are generated by the data driver 222.

Further, in FIG. 3, numeral 224 indicates a scanning driver, and numeral 225 indicates scanning line selection signals. The scanning driver 224 generates scanning line selection signals 225 based on the group of scanning driver signals 209 and outputs the scanning line selection signals 225 to scanning lines 226*b* of the liquid crystal display panel 226.

Here, although the detailed explanation is omitted, 1 pixel of the liquid crystal display panel 226 is constituted of a TFT (Thin Film transistor) which includes a gate electrode, a source electrode and a drain electrode, a pixel electrode, liquid crystal layer and a counter electrode. Here, in each pixel, the drain electrode is connected to the signal line 226*a* and the gate electrode is connected to the scanning line 226*b*. Further, a switching operation of the TFT is performed by applying the scanning signal to the gate electrode, wherein the data voltage (gradation voltage) is written in the source electrode via the drain electrode when the TFT is in an open state, and the voltage which is written in the source electrode is held when the TFT is in a closed state. A voltage of the source electrode is set as Vs and a voltage of the counter electrode is set as Vcom. Here, the liquid crystal layer changes the orientation thereof based on a potential difference between the voltage Vs of the source electrode (pixel electrodes) and the voltage Vcom of the counter electrode which are arranged above and below the liquid crystal layer, for example. Further, via polarizers which are arranged above and below the liquid crystal layer, a transmission light quantity from a backlight is changed and a gradation display is performed.

Figure 5:
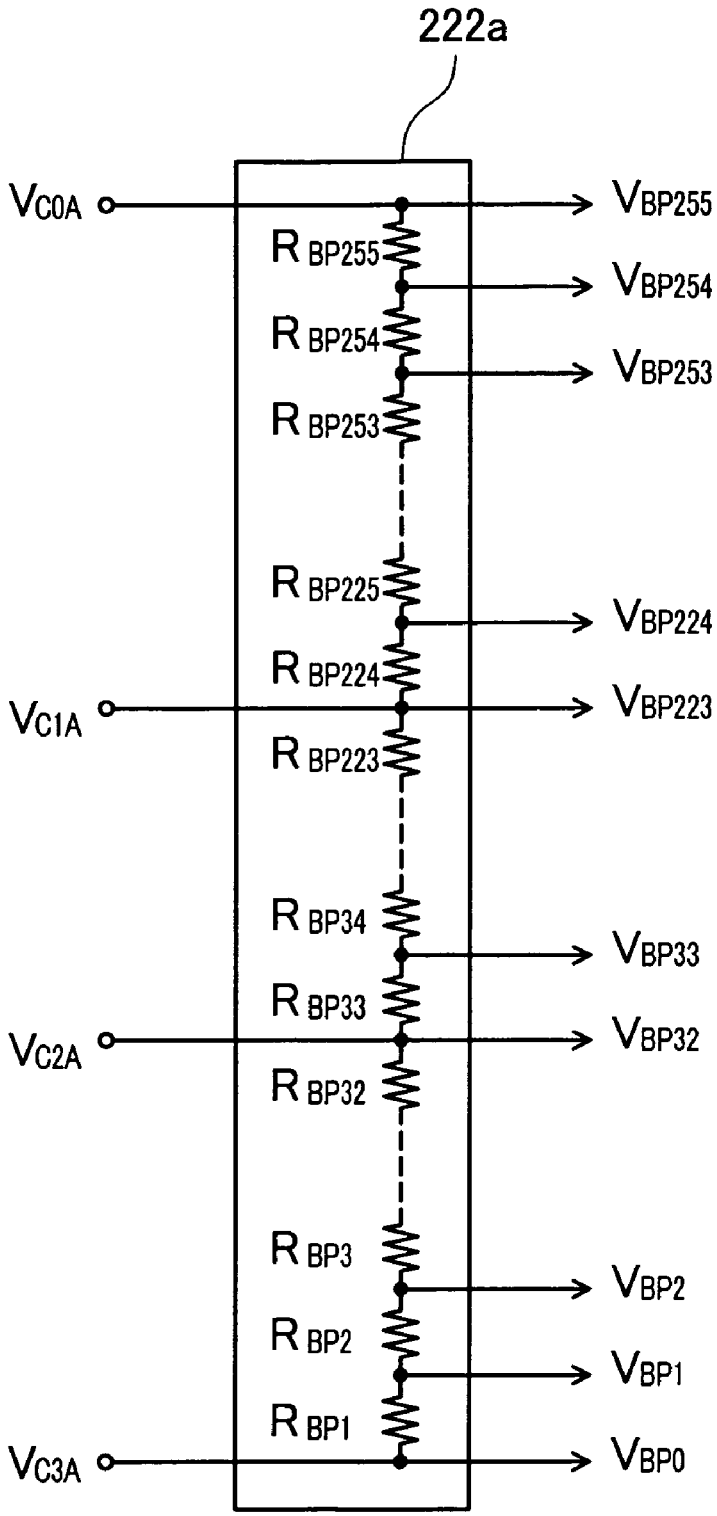
FIG. 5 is a schematic view showing a constitutional example of a first gradation voltage generation circuit of the data driver.
Figure 6:
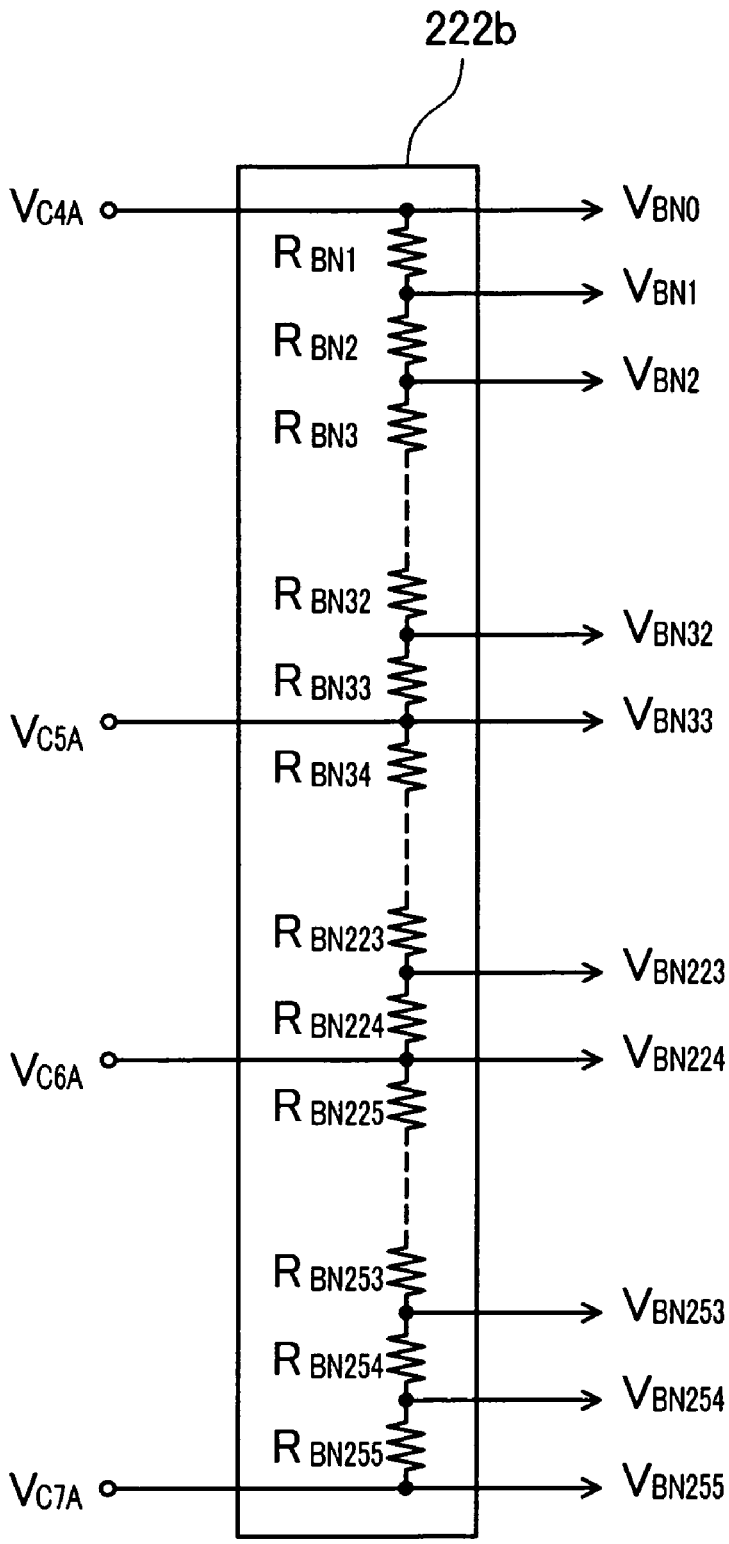
FIG. 6 is a schematic view showing a constitutional example of a second gradation voltage generation circuit of the data driver.
Figure 7:
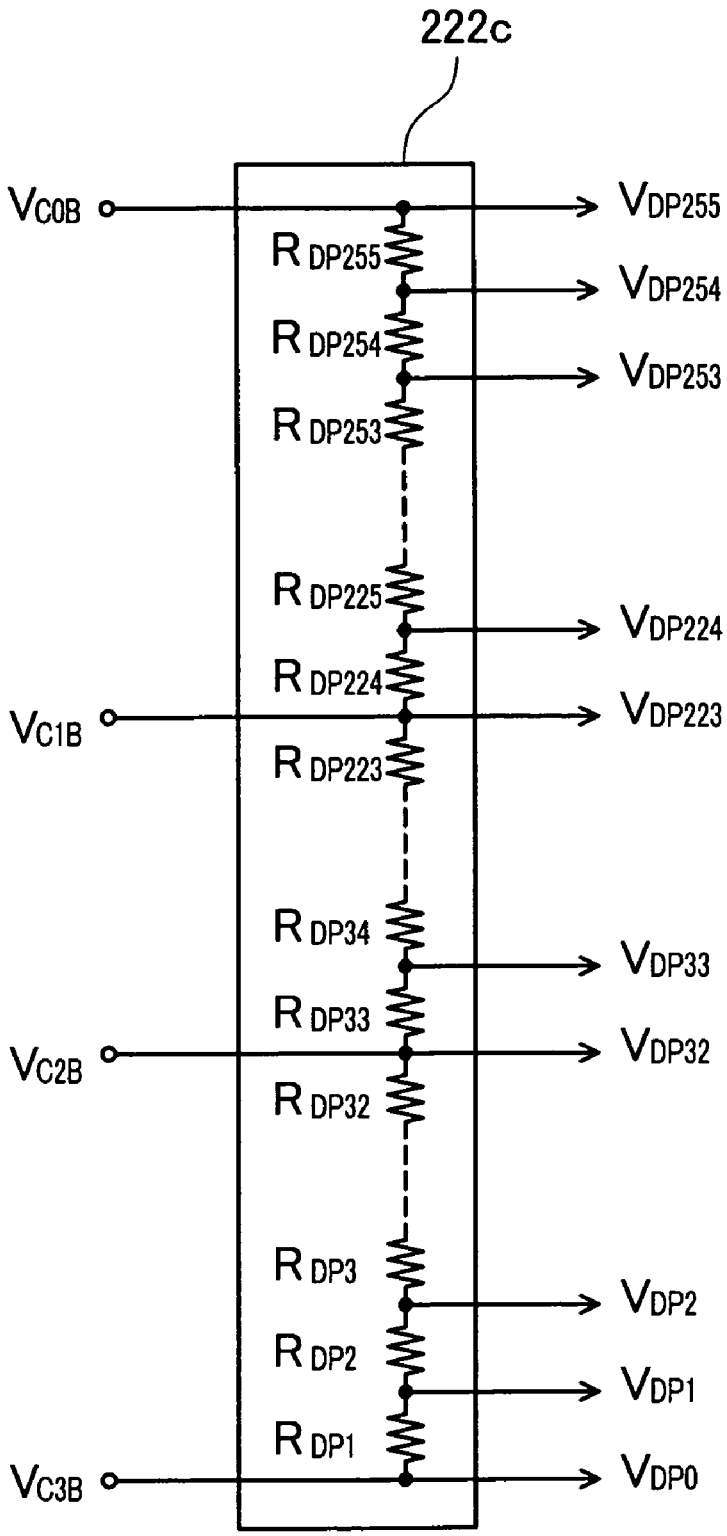
FIG. 7 is a schematic view showing a constitutional example of a third gradation voltage generation circuit of the data driver.
Figure 8:
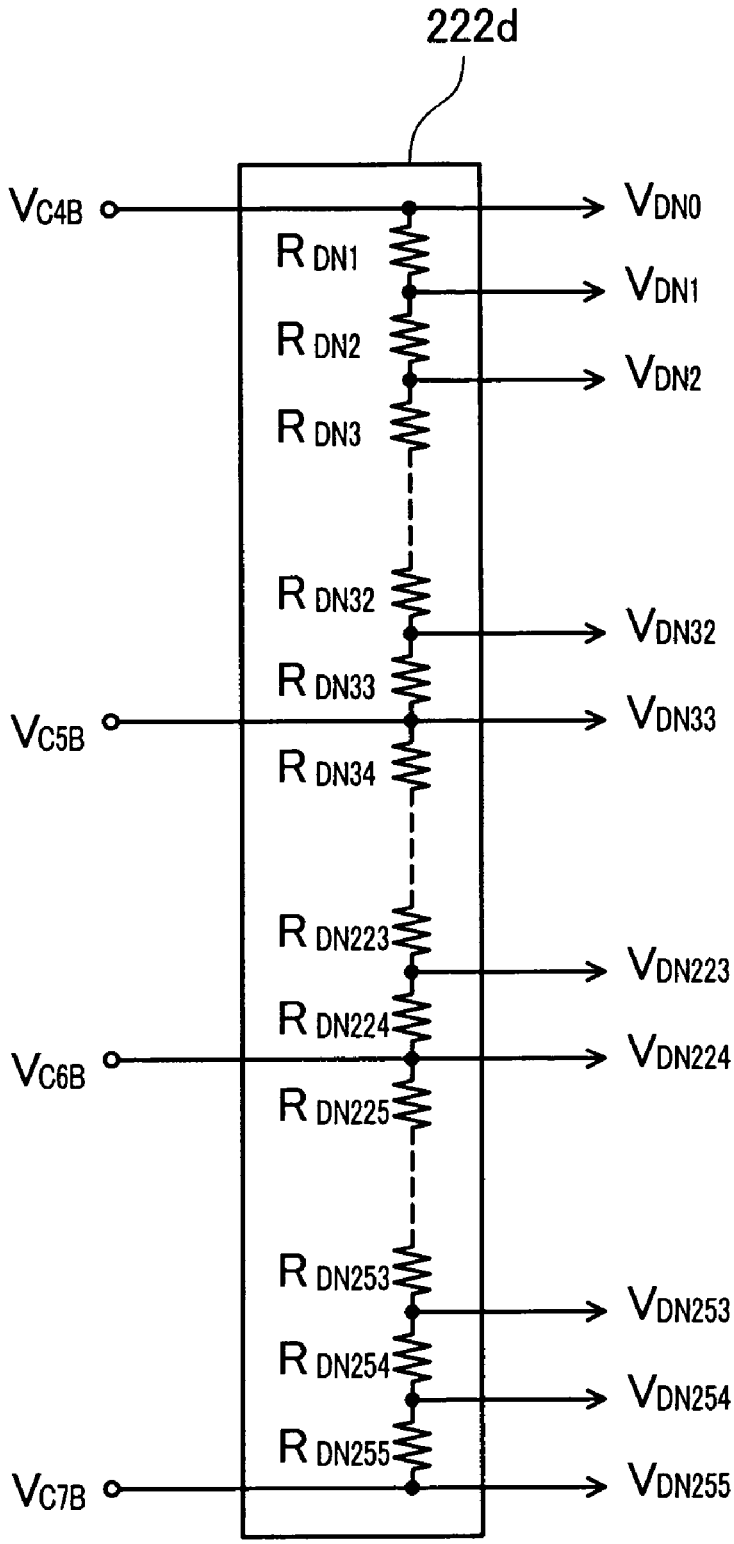
FIG. 8 is a schematic view showing a constitutional example of a fourth gradation voltage generation circuit of the data driver.

FIG. 5 is a schematic view showing a constitutional example of a first gradation voltage generation circuit of the data driver, FIG. 6 is a schematic view showing a constitutional example of a second gradation voltage generation circuit of the data driver. Further, FIG. 7 is a schematic view showing a constitutional example of a third gradation voltage generation circuit of the data driver. Further, FIG. 8 is a schematic view showing a constitutional example of a fourth gradation voltage generation circuit of the data driver.

In the liquid crystal display device of this embodiment, the data driver 222 includes, as shown in FIG. 4, four gradation voltage generation circuits 222*a*, 222*b*, 222*c*, 222*d*. Out of these four gradation voltage generation circuits, the first gradation voltage generation circuit 222*a* is a circuit which is used at the time of displaying the bright field display data in positive polarity and, for example, as shown in FIG. 5, is formed of a resistance voltage dividing circuit in which 254 pieces of resistances from $R_{BP1}$ to $R_{BP255}$ are connected in series. Here, the reference voltages $V_{C0A}$ to $V_{C3A}$ are inputted to the first gradation voltage generation circuit 222*a*, for example, and 256 pieces of voltages of positive polarity ranging from the voltage $V_{BP0}$ which corresponds to the minimum gradation (0 gradation) to the voltage $V_{BP255}$ which corresponds to the maximum gradation (255 gradation) are supplied to the gradation voltage selection means 222*e* by the resistance voltage dividing circuit.

Further, the second gradation voltage generation circuit 222*b* is a circuit which is used at the time of displaying the bright field display data in negative polarity and, for example, as shown in FIG. 6, is formed of a resistance voltage dividing circuit in which 254 pieces of resistances from $R_{BN1}$ to $R_{BN255}$ are connected in series. Here, the reference voltages $V_{C4A}$ to $V_{C7A}$ are inputted to the second gradation voltage generation circuit 222*b*, for example, and 256 pieces of voltages of negative polarity ranging from the voltage $V_{BN0}$ which corresponds to the minimum gradation (0 gradation) to the voltage $V_{BN255}$ which corresponds to the maximum gradation (255 gradation) are supplied to the gradation voltage selection means 222*e* by the resistance voltage dividing circuit.

Further, the third gradation voltage generation circuit 222*c* is a circuit which is used at the time of displaying the dark field display data in positive polarity and, for example, as shown in FIG. 7, is formed of a resistance voltage dividing circuit in which 254 pieces of resistances from $R_{DP1}$ to $R_{DP255}$ are connected in series. Here, the reference voltages $V_{C0B}$ to $V_{C3B}$ are inputted to the third gradation voltage generation circuit 222*c*, for example, and 256 pieces of voltages of positive polarity ranging from the voltage $V_{DP0}$ which corresponds to the minimum gradation (0 gradation) to the voltage $V_{DP255}$ which corresponds to the maximum gradation (255 gradation) are supplied to the gradation voltage selection means 222*e* by the resistance voltage dividing circuit.

Further, the fourth gradation voltage generation circuit 222*d* is a circuit which is used at the time of displaying the dark field display data in negative polarity and, for example, as shown in FIG. 8, is formed of a resistance voltage dividing circuit in which 254 pieces of resistances from $R_{DN1}$ to $R_{DN255}$ are connected in series. Here, the reference voltages $V_{C4B}$ to $V_{C7B}$ are inputted to the fourth gradation voltage generation circuit 222*d*, for example, and 256 pieces of voltages of negative polarity ranging from the voltage $V_{DN0}$ which corresponds to the minimum gradation (0 gradation) to the voltage $V_{DN255}$ which corresponds to the maximum gradation (255 gradation) are supplied to the gradation voltage selection means 222*e* by the resistance voltage dividing circuit.

Figure 9:
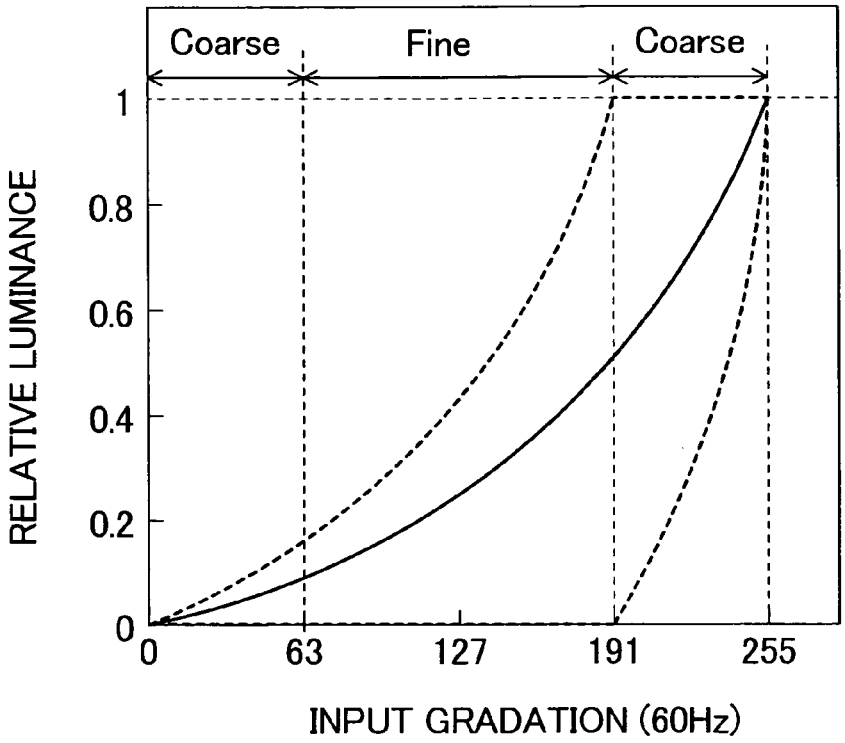
FIG. 9 is a view for explaining characteristics required when the gradation voltage generation circuit is constituted of a set of a circuit for a positive polarity and a circuit for a negative polarity.
Figure 10:
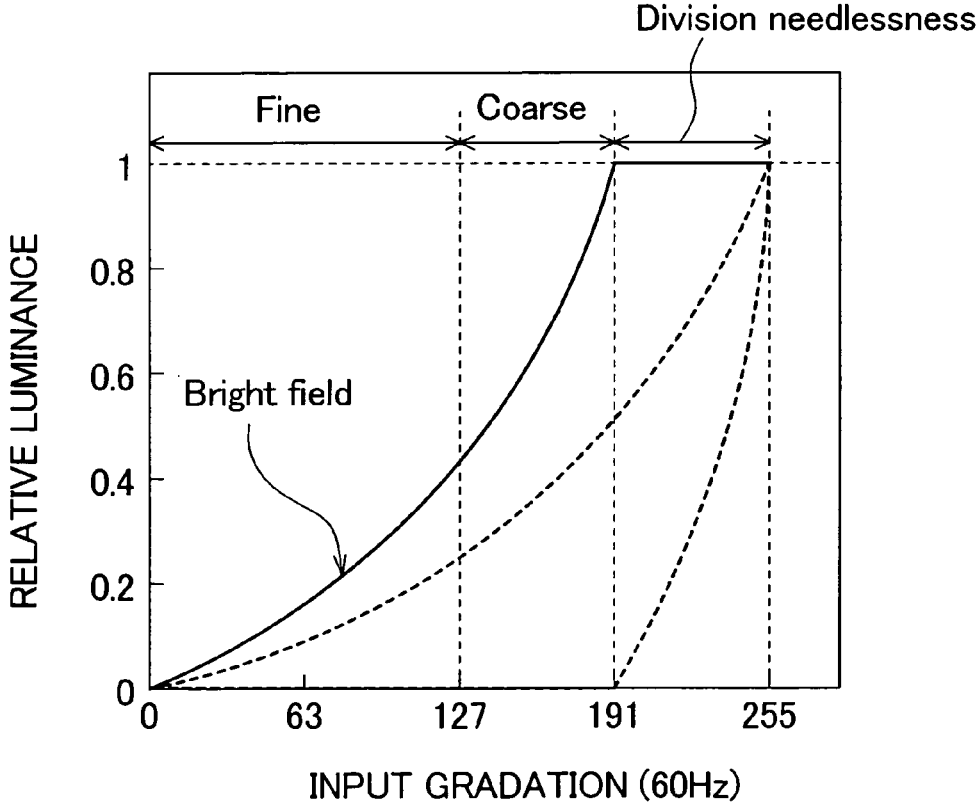
FIG. 10 is a view for explaining characteristics required to a gradation voltage of bright field display data.
Figure 11:
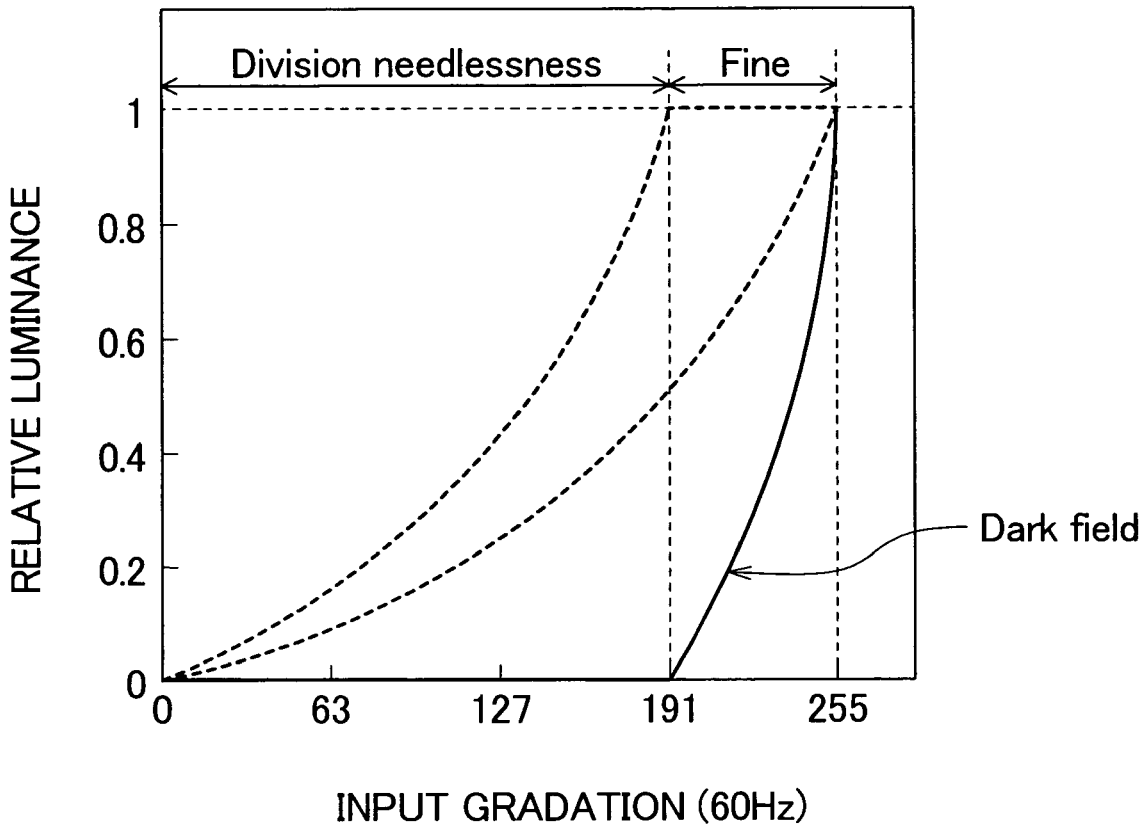
FIG. 11 is a view for explaining characteristics required to a gradation voltage of dark field display data.

FIG. 9 to FIG. 12 are schematic views for explaining one type of manner of operation and advantageous effects of the display device of this embodiment, wherein FIG. 9 is a view for explaining characteristics required when the gradation voltage generation circuit is constituted of a set of a circuit for a positive polarity and a circuit for a negative polarity, FIG. 10 is a view for explaining characteristics required to a gradation voltage of bright field display data, FIG. 11 is a view for explaining characteristics required to a gradation voltage of dark field display data, and FIG. 12 is a view showing an example in which resistance values of the respective resistance voltage dividing circuits are set.

In the display device of this embodiment, 1 frame is constituted of 2 fields, wherein by the method explained in conjunction with FIG. 2, the gradations required by the external system are converted into the bright field display data and the dark field display data, and these display data are displayed while being changed over during 1 frame period thus displaying the gradations required by the external system in a pseudo displaying manner.

Here, the gradation voltage generation circuits of the data driver 222 may be constituted of a set of a resistance voltage dividing circuit for positive polarity and a resistance voltage dividing circuit for negative polarity as in the case of a conventional display device. However, when the conventional resistance voltage dividing circuit is constituted of a set of data driver, a resistance division ratio of each resistance voltage dividing circuit is set in conformity with the gradation required by the external system. Here, as shown in FIG. 9, the resistance division ratio is set such that a potential difference of the gradation voltage becomes coarse on the low gradation side and the high gradation side and becomes fine in the intermediate gradation.

On the other hand, when the display data is converted into the bright field display data as in the case of this embodiment, as shown in FIG. 10, for example, the conversion is performed such that the relative luminance assumes the maximum luminance from the 191 gradation to 255 gradation and hence, it is sufficient to substantially change the gradation voltages between the minimum gradation (0 gradation) to 191 gradation. Here, to be more specific, it is preferable to set the resistance division ratio such that the potential difference is fine from the minimum gradation (0 gradation) up to the intermediate gradation, for example, up to approximately 127 gradation, the potential difference is coarse from approximately 127 gradation up to 191 gradation, and the potential difference is substantially 0 from the 191 gradation to 255 gradation.

Further, when the display data is converted into the dark field display data, as shown in FIG. 11, for example, the gradations ranging from the minimum gradation (0 gradation) to 191 gradation are converted such that the relative luminance assumes the minimum luminance. That is, it is sufficient to substantially change the gradation voltages between 191 gradation and the maximum gradation (255 gradation). Further, to be more specific, it is preferable to set the resistance division ratio such that the potential difference from the minimum gradation (0 gradation) up to approximately 191 gradation becomes substantially 0 and the potential difference from 191 gradation to 255 gradation becomes fine.

That is, when the display is performed by converting the display data into the bright field display data or the dark field display data as in the case of this embodiment, the voltage region and the voltage resolution which are necessary at the time of displaying the bright field display data and the voltage region and the voltage resolution which are necessary at the time of displaying the dark field display data differ from each other. Accordingly, with one set of resistance voltage dividing circuit having one positive polarity and one negative polarity respectively, it is difficult to acquire the gradation display characteristics proper to the display data of respective fields.

Accordingly, two sets of resistance voltage dividing circuits are provided to the device driver, wherein the resistance division ratio of one set is set in conformity with the voltage region and the voltage resolution necessary for the display of the bright field and the resistance division ratio of another set is set in conformity with the voltage region and the voltage resolution necessary for the display of the dark field and hence, the gradation display properties which are suitable for display data of respective fields can be acquired thus realizing the smooth gradation expression.

FIG. 12 shows an example in which values of the respective resistances of the first to fourth gradation voltage generation circuits are set when two sets of resistance voltage dividing circuits are provided to the device driver. That is, FIG. 12 shows an example in which the gradation and the luminance of the bright field display data and the gradation and the luminance of the dark field display data respectively have the relationship shown in FIG. 2. Here, the first gradation voltage generation circuit 222*a* and the second gradation voltage generation circuit 222*b* for the bright field set the resistance values of the resistances $R_{BP191}$ to $R_{BP255}$ and $R_{BN191}$ to $R_{BN255}$ from the 191 gradation to the maximum gradation (255 gradation) to 0 or approximately 0. Further, from the minimum gradation (0 gradation) up to the intermediate gradation, for example, up to the 127 gradation, the change of the potential difference is made fine using resistances having small resistance values. Then, from approximately 127 gradation to the 191 gradation, the change of the potential difference is made coarse using resistances having large resistance values.

Further, the third gradation voltage generation circuit 222*c* and the fourth gradation voltage generation circuit 222*d* for the dark field set the resistance values of the resistances $R_{RDP0}$ to $R_{RDP191}$ and $R_{DN0}$ to $R_{DN191}$ from the minimum gradation (0 gradation) to the 191 gradation to 0 or approximately 0. Then, from approximately 191 gradation to the maximum gradation (255 gradation), the change of the potential difference is made fine using resistances having small resistance values.

Here, it is needles to say that the resistance value setting example shown in FIG. 12 constitutes merely an example and the resistance values of the resistances are not limited to the above-mentioned values and can be suitably changed.

Further, when the resistance values of the respective gradation voltage generation circuits are set as shown in FIG. 12, for example, the potential difference may be set to 0 from 191 gradation to 255 gradation for the bright field and from 0 gradation to 191 gradation for the dark field. Accordingly, portions (gradations) to which the reference voltage is inputted may be increased on the low gradation side in the gradation voltage generation circuit for bright field, while portions (gradations) to which the reference voltage is inputted may be increased on the high gradation side in the gradation voltage generation circuit for dark field.

As has been explained heretofore, according to the display device of the present invention, it is possible to reduce the motion picture blurring while suppressing the lowering of luminance, the lowering of contrast and the increase of electric power necessary for emission of light.

Further, by providing the circuit which generates the gradation voltage of the bright field display data and the circuit which generates the gradation voltage of the dark field display data independently from each other, it is possible to generate gradation voltages with the voltage regions and the voltage resolutions which become necessary for respective field display data thus realizing the smooth gradation display.

Further, in this embodiment, the case in which 1 frame is constituted of 2 fields is exemplified. However, this embodiment is not limited to the above-mentioned case and 1 frame may be constituted of 3 fields or 4 fields. In this case, at least 1 field may be set to the dark field.

Although the present invention has been specifically explained in conjunction with the embodiments, it is needless to say that the present invention is not limited to the above-mentioned embodiments and various modifications are conceivable without departing from the gist of the present invention.

For example, although the liquid crystal display device is exemplified in the above-mentioned embodiments, it is needless to say that the present invention is not limited to such a case and the present invention is applicable to a hold response type display device which displays motion pictures based on a principle substantially equal to the principle of the above-mentioned liquid crystal display device. That is, the present invention is also applicable to a display device such as an organic EL display or an LCOS display, for example.

What is claimed is:

1. A display device which displays gradations corresponding to display data inputted from an external system, the display device comprising:

a display panel having a plurality of pixels arranged in a matrix array;

a data driver which outputs voltages corresponding to the gradations of the display data to the pixels of the display panel;

a scanning driver which scans the pixels to which the voltages are to be supplied, first and second gradation conversion circuits which convert an intermediate gradation of the display data to a second gradation different from the intermediate gradation; and a signal generation circuit which generates a control signal for driving the display panel based on an input signal from the external system;

wherein:

the signal generation circuit generates a control signal to divide the display data of one frame into the plural fields for chronological order, each pixel of the display panel displays one gradation which is required by an external system by displaying the gradation of each field in one frame period, when gradation required by the external system is a middle gradation between a greatest gradation and a smallest gradation, at least one field of the each field in one frame period is a bright field to be displayed with a brightness that is higher than a brightness corresponding to a gradation required by the external system, and another field is a dark field to display with the brightness that is lower than the brightness corresponding to gradation required by the external system, a gradation voltage of the bright field and the dark field are generated by different gradation voltage generation circuits, the gradation voltage generation circuit for the bright fields includes a resistance division ratio set so that a potential difference of the low gradation side becomes coarse, and the gradation voltage generation circuit for the dark fields includes a resistance division ratio is set so that a potential difference of the high gradation side becomes coarse.

2. A display device which displays gradations corresponding to display data inputted from an external system, the display device comprising:

a display panel having a plurality of pixels which is arranged in a matrix array;

a memory which is capable of holding the display data inputted from the external system amounting to 1 frame period;

first and second gradation conversion circuits which convert an intermediate gradation of the display data to a gradation different from the intermediate gradation;

a signal generation circuit which generates a control signal for driving the display panel based on an input signal from the external system;

a data driver which outputs voltages corresponding to the gradations of the display data to the pixels of the display panel; and a scanning driver which scans the pixels to which the voltages are to be supplied, wherein the data driver includes a first voltage generation circuit which generates voltages to be outputted to the respective pixels of the display panel based on the display data converted by the first gradation conversion circuit, and a second voltage generation circuit which generates voltages to be outputted to the respective pixels of the display panel based on the display data converted by the second gradation conversion circuit, wherein the first and second voltage generation circuits are respectively formed of a resistance voltage dividing circuit in which a plurality of resistances is connected in series, a resistance division ratio of the first voltage generation circuit is set such that the resistance division ratio on a high gradation side out of the intermediate gradation is substantially 0, and a resistance division ratio of the second voltage generation circuit is set such that the resistance division ration on a low gradation side out of the intermediate gradation is substantially 0, the first gradation conversion circuit converts gradations of the first display data read out from the memory firstly, the second gradation conversion circuit converts gradations of the second display data read out from the memory secondly, when the display data inputted from the external system is an intermediate gradation, luminance attributed to the second display data after conversion is lower than luminance attributed to the first display data after conversion, the second driver scans the pixels twice within 1 frame period in response to the control signal, and the data driver outputs the voltage which is generated by the first voltage generation circuit corresponding to the first display data after conversion to the pixels in response to the first scanning by the scanning driver, and outputs the voltage which is generated by the second voltage generation circuit corresponding to the second display data after conversion to the pixels in response to the second scanning by the scanning driver.

3. A display device according to claim 2, wherein a reference voltage generation circuit connected to the data driver generates a reference voltage that is inputted to the first and second voltage generation circuits from a plurality of portions respectively, the first voltage generation circuit has many portions to which the reference voltage is inputted on the low gradation side, and the second voltage generation circuit has many portions to which the reference voltage is inputted on the high gradation side.

* * * * *